US008662867B2

(12) United States Patent
Vedsted

(10) Patent No.: US 8,662,867 B2
(45) Date of Patent: Mar. 4, 2014

(54) BORE-HOLE PUMP

(75) Inventor: Per Frost Vedsted, Bjerringbro (DK)

(73) Assignee: Grundfos Management a/s, Bjerringbro (DK)

( * ) Notice: Subject to any disclaimer, the term of this patent is extended or adjusted under 35 U.S.C. 154(b) by 676 days.

(21) Appl. No.: 12/500,174

(22) Filed: Jul. 9, 2009

(65) Prior Publication Data

US 2010/0008799 A1 Jan. 14, 2010

(30) Foreign Application Priority Data

Jul. 10, 2008 (EP) ..... 08012459

(51) Int. Cl.
*F04D 1/06* (2006.01)
*F04D 13/08* (2006.01)
*F04D 13/10* (2006.01)

(52) U.S. Cl.
USPC ..... 417/423.14; 417/53; 417/360; 417/423.3

(58) Field of Classification Search
USPC ..... 417/244, 360, 423.3, 423.14, 423.15, 417/424.2, 53
See application file for complete search history.

(56) References Cited

U.S. PATENT DOCUMENTS 2,667,128 A 1/1954 Bergh
2,722,892 A * 11/1955 French ..... 417/423.3
2,809,590 A 10/1957 Brown
2,939,400 A * 6/1960 Maynard ..... 417/423.3
3,267,868 A 8/1966 Page
3,288,074 A 11/1966 Hall
3,438,329 A * 4/1969 Fuller ..... 415/199.3
4,586,880 A * 5/1986 Inao et al. ..... 417/423.9
5,628,616 A * 5/1997 Lee ..... 415/58.2
6,398,521 B1 * 6/2002 Yorulmazoglu ..... 417/360

FOREIGN PATENT DOCUMENTS

DE 653732 C 12/1937
DE 1003340 B 2/1957
WO 9925055 A1 5/1999

OTHER PUBLICATIONS

Anonymous, "Grundfos submersible pumps—the complete solution," Brochure, (Apr. 2006).
EP Search Report issued Feb. 3, 2009 by the EP Patent Office in counterpart EP Application No. 08 01 2459.7 (enclosed with English translation of pertinent parts of the EP Search Report).
Office Action issued Aug. 2, 2012 in CN Application No. 200910140190.6.
Office Action issued Apr. 15, 2013 in CN Application No. 20090140190.6.

* cited by examiner

*Primary Examiner* — Peter J Bertheaud
(74) *Attorney, Agent, or Firm* — Panitch Schwarze Belisario & Nadel LLP

(57) ABSTRACT

A bore-hole pump formed of stainless steel comprises a head part and a foot part, between which one or more pump stages are incorporated. The foot part serves to connect the pump to a drive motor. The pump includes inlet openings for fluid to be delivered. The foot part consists of at least two components which are separated in one or more essentially radial planes and are formed with different manufacturing methods.

11 Claims, 3 Drawing Sheets

BORE-HOLE PUMP

BACKGROUND OF THE INVENTION

The invention relates to a bore-hole pump with a head part and a foot part.

Bore-hole pumps of this type are provided for delivering water out of earth bore-holes, typically wells. All water-leading components thereby consist of stainless steel, thus of a corrosion-resistant material, and the other components are at least hermetically encapsulated, e.g. by way of a stainless steel jacket. The construction of the pumps is such that in the working position, thus typically on lowering into an essentially vertically running bore-hole, the lowermost part of the assembly is an electrical drive motor, to which the actual pump connects to the top. The pump comprises a foot part, which on the one hand serves for connection of the pump to the motor, and which on the other hand forms the inlet for the water to be delivered, and which finally, together with the head part arranged at the upper end, serves for clamping in the pump stages located between the head part and foot part.

Such pumps are counted as belonging to the state of the art, and in this context, the pumps of the SP construction series manufactured by the company Grundfos are referred to.

The pump stages of these known pumps are manufactured of stainless steel sheet metal. The motor is likewise encapsulated in stainless steel sheet metal. The foot part which was previously manufactured likewise in laborious manner as a steel sheet metal design of stainless steel, with the current pumps of the SP construction series, are manufactured by stainless steel precision casting. The casting components are quite complicated due to the undercuts, since they need to be manufactured with lost wax.

BRIEF SUMMARY OF THE INVENTION

It is an object of the present invention to provide a bore-hole pump, which in particular may be manufactured in an inexpensive and simple manner in series manufacture, in particular with regard to the foot part, which until now has been manufactured in a laborious manner.

Briefly stated, a preferred embodiment of the present invention is directed to a bore-hole pump with a head part and with a foot part consisting of stainless steel, between which one or more pump stages are incorporated, and with which the foot part is designed for connection of the pump to a drive motor, and comprises inlet openings for the fluid to be delivered, according to the invention, is characterized in that the foot part consists of at least two components which are separated in one or more essentially radial planes, and formed with different manufacturing methods.

The basic concept of the inventive design of the foot part, is not to design this as a component formed in one manufacturing method, thus e.g. as a component welded of sheet metal parts or as a precision cast part, as was previously the case, but to construct the foot part of two or more components, which are manufactured with different manufacturing methods, wherein the partition plane of the components according to the invention, is selected such that this is arranged in an essentially radial manner, thus quasi in a section plane transverse to the longitudinal axis of the bore-hole pump. With such a design, it has been surprisingly found that in particular with series manufacture, the foot part may be manufactured significantly more economically than this was previously the case, and this being the case without any disadvantages with regard to the functionality, in particular the strength and the function of the component, specifically on the one hand to form a mechanically stable connection to the drive motor, and on the other hand to form a mechanically stable connection to the head part and the pump stages which are clamped therebetween, and finally to ensure a suitable suction location of the pump with a certain sieve function, but with an adequate flow cross section.

Thereby, according to a preferred embodiment of the present invention, the components which are formed in different manufacturing methods, as will be yet described in detail further below, may be bodily separated as well as also joined together into a single-part component in the further manufacturing method, for example with a material fit by way of welding.

According to one advantageous further design of a preferred embodiment of the present invention, a motor-side component of the foot part is provided, which is manufactured with a casting method. Preferably, only one motor-side component of the foot part is provided, which is manufactured with a casting method, and the component or all further components of the foot part are formed with different manufacturing methods. Thereby, the motor-side component which is manufactured with a casting method, advantageously comprises receivers for fastening means for connection to the motor and/or to the head part. In particular, receivers are provided for fastening to the motor, which are formed by bearing surfaces which must essentially transmit compressive forces, whereas the remaining component is also loaded with tension. A cast part is particularly suitable as far as this is concerned. This, with a suitable design, may be formed without lost wax and thus may also be produced in a comparatively inexpensive manner.

Advantageously, the foot part comprises a pump-side component, which has receivers for fastening means for connection to the head part. Such a pump-side component serves for the connection to the head part and for fastening the pump stages clamped between the head part and the foot part. The receivers which are formed in this manner, should likewise transmit essentially compressive forces, whereas the component itself at the same time is also that component which forms the delivery fluid inlet of the pump. This then is particularly advantageously manufactured with the metal injection moulding (metal powder injection moulding) method. With this method, one may in particular also form a multitude of inlet openings which are typically arranged on the peripheral side and which on the one hand form a sieve function with respect to coarser particles, and on the other hand however have an adequately large suction cross section. The metal powder injection moulding method is particularly well suitable with regard to this, since with this, on the one hand one may form filigree structures and also undercuts without lost wax, but on the other hand one may manufacture highly loadable components which are highly precise with regard to tolerance, and may therefore often be applied without any further post-machining.

According to an advantageous further formation of a preferred embodiment of the present invention, the motor-side component and the pump-side component are connected to one another by way of welding, thus into a single-piece component. Thus for example, the motor-side component may be manufactured as a precision cast component and may be manufactured without lost wax on account of the shaping, whereas the pump-side component is manufactured with the metal powder injection moulding method, and in this manner undercuts may be realized also without lost wax. After welding the components, for example by way of a peripheral welding seam, thus a single-part component results on the peripheral side, without having to apply material-removing machining.

In order on the one hand to realize an as fine-structured as possible sieve function, but on the other hand to realize an as large as possible suction cross section, according to the invention, the pump-side component comprises a cylinder-jacket shaped component, which forms the inlet openings and which may advantageously be formed of sheet metal. This sheet metal component thus then essentially serves for forming the inlet openings and may advantageously be manufactured of a punched part of stainless steel sheet metal, which is bent into a cylinder-shaped component, and is connected at the end side, e.g. by way of welding. Such a component is inexpensive and efficient in manufacture, in particular in series manufacture and large series manufacture.

Alternatively, the cylinder-jacket shaped component may be formed as a deep-drawn part which comprises a flange-like part which is envisaged for bearing on a pump stage. Thereby, the inlet openings in the cylinder jacket are advantageously formed before the deep drawing procedure, e.g. by way of punching, so that the component after the deep drawing requires no further machining as far as this is concerned. The flange-like part serves for the bearing of the pump stage which bears on the foot part, and forms the bearing surface. Such a flange-like part may be formed without further ado with the deep-drawing method.

According to a further formation of a preferred embodiment of the present invention, the foot part is not only manufactured of two components of different manufacturing methods, but is formed by two or more components which are bodily separated from one another. Thus, according to an advantageous further design of the invention, the cylinder-shaped component may be clamped as a separate component between the motor-side component and the suction side of the first pump stage, with a positive fit, without the provision of further connections. Preferably, this is effected whilst integrating a diffuser or a modified diffuser. The latter components are present as sheet-metal components or preferably as components manufactured with the metal (powder) injection moulding method, and they are manufactured in their multitude in an inexpensive manner with stainless steel, so that further manufacturing costs may be saved when using such a component.

The later arrangement is particularly advantageous if, according to the invention, the receivers of the motor-side component project beyond the radial partition plane between the motor-side component and the pump-side component and peripherally overlap the cylinder-jacket shaped component. Then, the cylinder-jacket shaped component is not only clamped in an axial manner, but is also held radially with a positive fit by way of the projecting component. With these receivers projecting beyond the pump-side component, it is the case typically of the receivers for fastening means of the head part, with which the pump stages may be clamped between the head part and the foot part. This arrangement has the advantage that by way of the fact that the receivers for the fastening means project upwards beyond the partition plane, thus are relocated outwards to the pump, the free space in the motor-side component for the receivers for the fastening means becomes larger towards the motor, or the foot part more compact, thus may be constructed with a comparably smaller axial length.

Advantageously, according to a further formation of a preferred embodiment of the invention, the motor-side component is designed such that it comprises a radial intermediate wall, which has a recess for leading through the motor shaft, via which the shaft coming from the motor and leading into the pump stages is arranged in a freely rotatable manner. Moreover, this radial intermediate wall advantageously on the peripheral side comprises projections which are directed at least in sections towards the motor, and which form the receivers for the fastening means for connection to the head part. These projections directed to the motor serve for fastening ends of flat straps which run out in a hook-like manner and which typically run peripherally from the head part to the foot part, with a positive fit and thus for fixing the pump stages lying therebetween. Thereby, the radial intermediate wall is advantageously not only provided with these projections directed towards the motor, but furthermore with recesses which are radially concentric to the projections but which lie further inwards, in which recesses the free ends of the hook-like ends of the straps may engage for the connection to the head part. The manufacturing tolerances of the hook-like ends of the straps may be significantly enlarged and/or the axial length of the projections may be reduced by way of these recesses. This too leads to a more compact construction or to an improved accessibility of the fastening means for the drive motor in the foot part.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
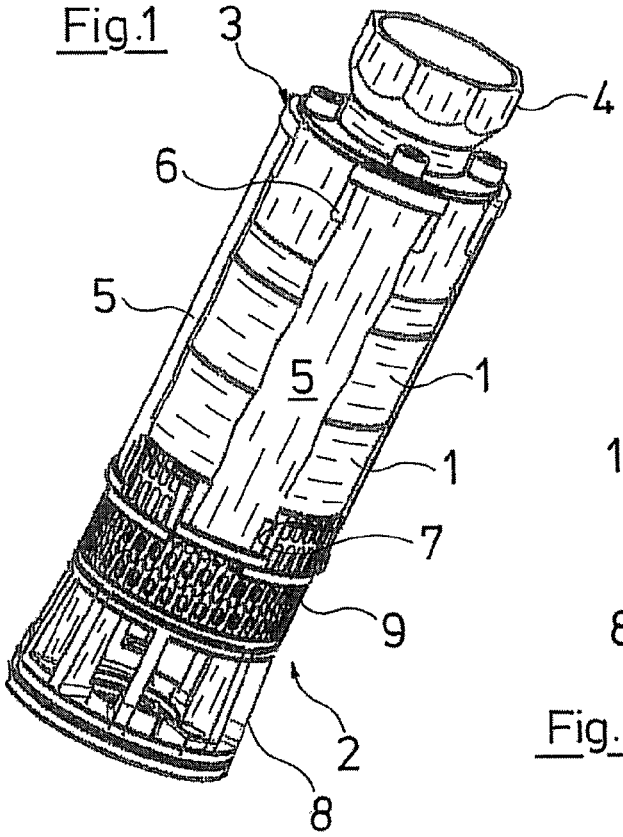
FIG. 1 is a simplified perspective representation of a pump-side component of a bore-hole pump according to a preferred embodiment of the present invention.

Certain terminology is used in the following description for convenience only and is not limiting. The words "right," "left," "lower" and "upper" designate directions in the drawings to which reference is made. The words "first" and "second" designate an order of operations in the drawings to which reference is made, but do not limit these steps to the exact order described. The words "inwardly" and "outwardly" refer to directions toward and away from, respectively, the geometric center of the pump and designated parts thereof. Additionally, the term "a" and "an," as used in the specification, mean "at least one." The terminology includes the words above specifically mentioned, derivatives thereof, and words of similar import.

With regard to the bore-hole pump represented in FIG. 1, only the pump-side part is shown, and the encapsulated drive motor connects to this at the bottom, as is known and common with pumps of this type, and the shaft of this drive motor projects upwards into the pump and serves for the drive of the impellers of the individual pump stages 1. The pump itself comprises a foot part 2 which is provided for connection to the drive motor, and a head part 3, which at its upper end comprises a connection 4 for the delivery conduit. The pump stages 1 are incorporated between the foot part 2 and the head part 3, in each case in the form of an impeller driven by the shaft of the drive motor, and of a diffuser which connects thereto, which are connected in series as a componentry, depending on the pump type. Two pump stages 1 are provided with the pump represented in FIG. 1.

Tightening straps 5 are provided between the head part 3 and the foot part 2, which are fixed in receivers 6 on the head part, and upper receivers 7 on the foot part. In the embodiment variant represented by way of FIG. 1, the tightening straps 5 taper in sections, so that the tightening straps 5 in the receivers 6, 7 are fastened with a positive fit by way of suitable wedge surfaces which are in contact with the tightening straps 5 at the edge side. However here, one may basically also apply other suitable fastening systems.

The foot part 2, which is shown in detail by way of FIGS. 2-5, comprises a motor-side component 8, which is provided for bearing on the drive motor which is not shown, as well as a pump-side component 9, which is provided for bearing on the lowermost pump stage 1. The motor-side component 8 comprises lower receivers 10 for fastening the drive motor. The drive motor comprises four stud bolts which project upwards in an axis-parallel manner at the end-side, and which pass through the lower ring 11 of the motor-side component 8 of the foot part 2, and on the other side of the receivers 10 are provided with a thread and there are fixed in each case by way of a nut. Four legs 12 are provided directed upwards from this ring 11, on whose upper ends a radial intermediate wall 13 connects, which comprises a central recess 14 for the shaft of the drive motor and is designed stepped on the outer periphery for receiving the pump-side component 9. The free spaces formed between the legs 12 between the receivers 10 and the radial intermediate wall 13 are needed to be able to attach the nuts on the end-side ends of the stud bolts of the drive motor, as well otherwise being able to tighten these with a tool.

Figure 4:
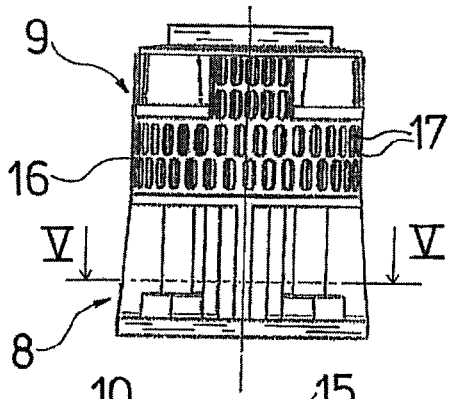
FIG. 4 an elevation view of the foot part shown in FIG. 2.
Figure 5:
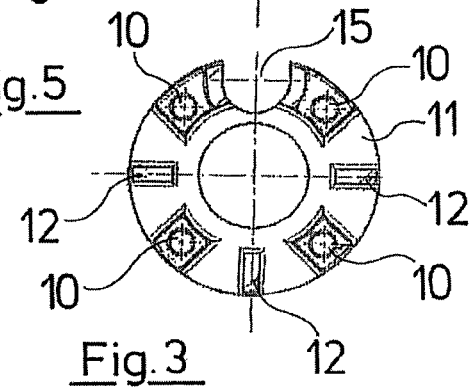
FIG. 5 is a cross-section view along section line V-V in FIG. 4.

As the illustration according to FIG. 4 in particular illustrates, the ring 11 has a greater outer periphery than the radial intermediate wall 13, and the free space formed peripherally to the top, on the outer periphery of the pump, serves for leading the electrical connection cable which is not shown in the figures and which is led out of the drive motor at the end side, and in the motor-side component 8 is led out in a suitable guide groove 15 in one of the legs 12.

The motor-side component 8 represented by way of FIGS. 1 to 5 is designed as a precision cast part of stainless steel. The motor-side component 8 connects to this component at the top, thus in the direction of the pump, and comprises a cylinder-jacket shaped section 16 which is provided with a multitude of inlet openings 17 and which close to its upper end 4 comprises receivers 7 on the outer periphery, which serve for fixing the tightening straps 5. The cylinder-jacket shaped section 16 at its upper end comprises an inwardly drawn flange 18, on which a collar 19 extending axially towards the pump stage 1 projects. This collar 19 is provided for the positive-fit integration into the suction port of the lowermost, first pump stage 1.

Figure 2:
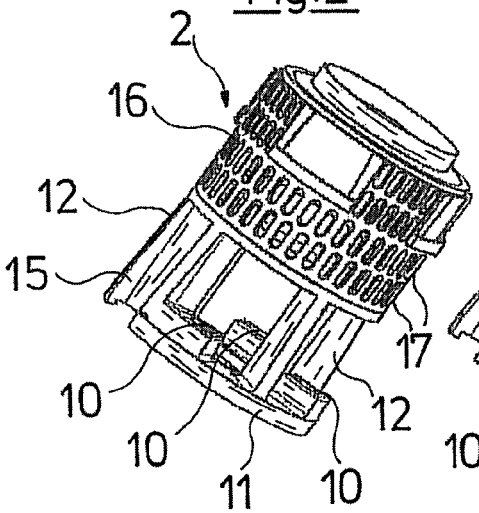
FIG. 2 is an enlarged representation of a foot part of the pump shown in FIG. 1.
Figure 3:
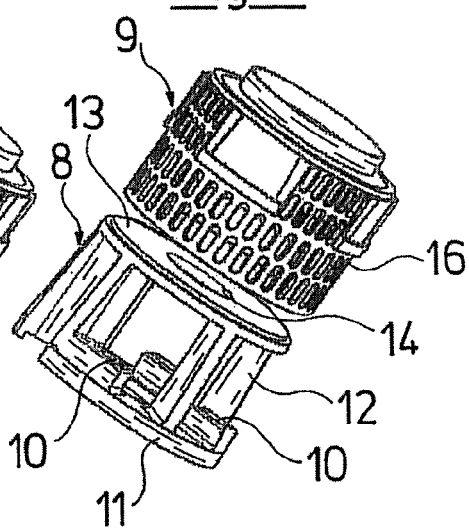
FIG. 3 is a representation of a motor-side component and the pimp-side component shown in FIG. 2 before connection.

This pump-side component 9 is manufactured with the metal (powder) injection moulding method, so that it requires no further machining after the manufacture. The components 8 and 9 are joined together at their radial partition plane, which lies roughly in the region of the upper side of the radial intermediate wall 13, and there are peripherally welded to one another, so that a single-piece foot part 2 results, as is represented in FIGS. 2 and 4.

Figure 6:
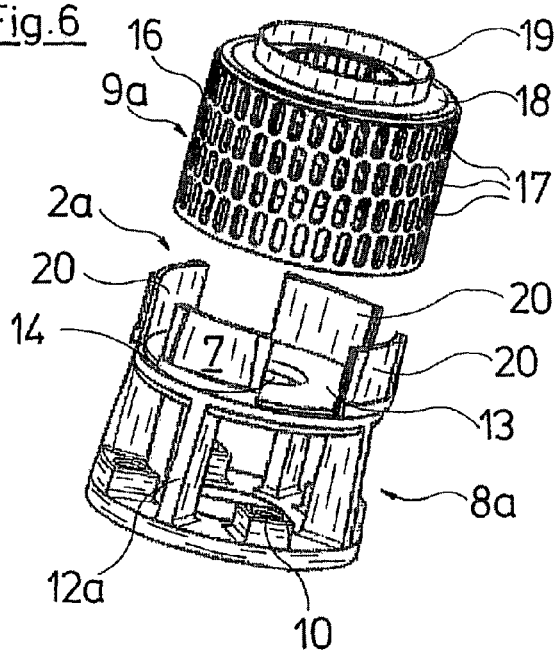
FIG. 6 is a perspective representation of a foot part according to a second preferred embodiment of the present invention.

The foot part 2*a* represented by way of FIG. 6 differs from the previously described one essentially by way of the fact that the motor-side component 8*a* does not end in the partition plane formed by the upper side of the intermediate wall 13, but that four projections 20 projecting upwards, thus in the direction of the pump stages 1, are provided there, which essentially follow the outer cross-sectional contour in this region, and form the upper receivers 7 for connection to the tightening straps 5. The pump-side component 9*a* likewise comprises a cylinder-jacket shaped section 16 which however here, in a continuous manner, over the whole periphery and the whole height, is provided with inlet openings 17, and on its upper side is likewise provided with a flange 18 and a collar 19. The arrangement of the projections 20 is such that in the assembled condition, the cylinder-jacket shaped section 16 comes to bear within the projections 20, and at the end-side stand up on the intermediate wall 13. With this embodiment variant, a connection of the components 8*a* and 9*a* to one another is not required, since the pump-side component 9*a* is held radially in all directions and axially to the bottom with a positive fit by way of the motor-side component 8*a*, due to the fact that the receivers 7 are relocated into the motor-side component 8*a* and are formed by the projections 20. The further interconnection is then effected together with the pump stages 1 between the head part 3 and the motor-side component 8*a* by way of the tightening straps 5.

The previously described pump-side component 9*a* may be manufactured in an inexpensive manner as a deep drawn part from stainless steel sheet metal or alternatively by way of sheet metal parts, for example by way of the cylinder-jacket shaped section 16 being formed from a stainless steel sheet section bent into a ring, which is welded at a seam location, thus at two sides which face one another, and at its upper side is connected to a flange component 18, 19 which is formed of sheet metal and which is either incorporated with a positive fit or is welded to the cylinder-jacket shaped section 16. The motor-side component 8*a* is manufactured as a cast part of stainless steel.

Figure 9:
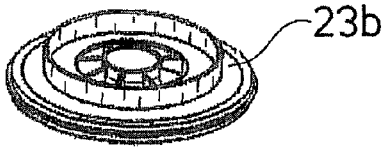
FIG. 9 is a perspective representation of a diffuser of the pump.
Figure 7:
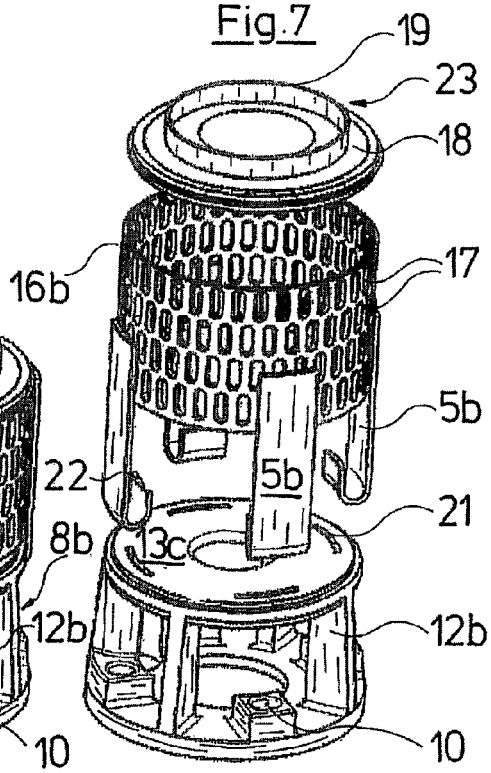
FIG. 7 is an exploded representation of a foot part according to a third preferred embodiment of the present invention.
Figure 8:
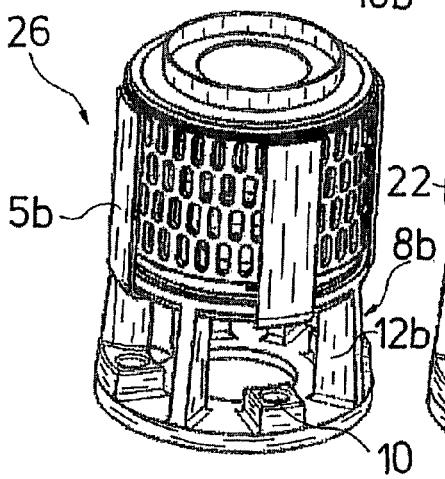
FIG. 8 is a perspective representation of the assembled foot part shown in FIG. 7.

With the embodiment variant represented by way of FIGS. 7 to 9, the foot part 2*b* corresponds essentially to that described by way of FIGS. 1 to 5, wherein the legs 12*b* are designed shorter than those of the first embodiment example. However, four recesses 21 which are arranged on a circle at a slight distance to the outer periphery are provided in the radial intermediate wall 13*b*, and are designed curved according to the circle and are provided for receiving the free ends 22 of tightening straps 5*b* which are designed in a hook-like manner to the bottom, which in each case engage into the free spaces formed by two adjacent legs 12*b* and come to bear with a positive fit in the recesses 21. Here therefore, the receivers for the fastening means to the head part 3 are formed by recesses 21, through which the free ends 22 of the ends of the tightening straps 5*b* and which are formed in a hook-like manner, pass.

The pump-side component 9*b* with the embodiment variant according to the FIGS. 7 to 9 is formed by two separate components, specifically a cylinder-jacket shaped component 16*b*, as well as a cover plate 23 which engages into this with a positive fit and which likewise comprises a flange 18 as well as a collar 19, but furthermore also a downwardly projecting collar 24, which in the assembled position engages from above into the cylinder-jacket shaped component 16*b* with a positive fit. The cover plate 23 may be designed of sheet metal in a simple manner. However, as is also illustrated in FIG. 9 by way of example, a diffuser 23*b* of a pump stage 1, as the case may be, in a modified form, may be used for this, which is manufactured with metal (powder) injection moulding. The motor-side component 8*b* is a precision casting part of stainless steel.

Figure 11:
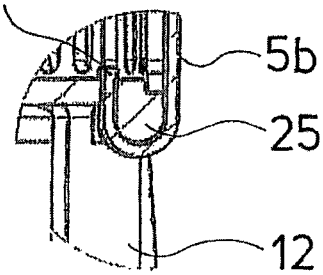
FIG. 11 is an enlarged representation of detail XI of FIG. 10.
Figure 10:
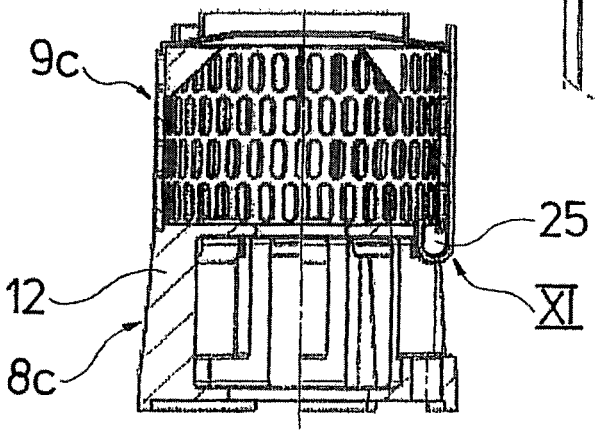
FIG. 10 is a elevation view of a foot part according to a fourth preferred embodiment of the present invention.

A further fastening variant is represented by way of FIGS. 10 to 11. There, the motor-side component 8*c* comprises projections 25 which extend from the outer periphery of the radial intermediate wall 13 in each case between legs 12, downwards towards the drive motor and behind which the hook-like ends of the tightening straps 5*b* engage. Here too, the free ends 22 may also be incorporated in recesses 21 of the intermediate wall 13*b*. With this embodiment, the cylinder-jacket shaped component 16*b* as well as the cover plate 23 and 23*b* of the previously described embodiment may be used.

The previously described manufacturing methods are only to be understood by way of example, and they may be combined with one another in another manner in order to manufacture the foot part 2 as inexpensively as possible.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A bore-hole pump comprising:

a head part and a foot part consisting of stainless steel, between which one or more pump stages are incorporated, wherein the foot part connects the pump to a drive motor and comprises inlet openings for the fluid to be delivered, wherein the foot part comprises at least a motor-side component and a pump-side component, each component extending in a separate plane perpendicular to a longitudinal axis of the bore-hole pump, the motor-side component and the pump-side component being connected to one another by welding, the motor-side component being a cast part and comprising receivers for fastening to the motor or the head part, and the pump-side component being a metal injection-molded part, the pump-side component comprising receivers for fastening to the head part and a cylinder-jacket shaped component forming the inlet openings, the cylinder-jacket shaped component being formed of a sheet metal section which is bent and connected at an end-side.

2. The bore-hole pump according to claim 1, wherein at least a portion of the cylinder-jacket shaped component bears on a pump stage.

3. The bore-hole pump according to claim 2, wherein the cylinder-jacket shaped component is clamped with a positive fit between the motor-side component and a suction side of a first pump stage, with the incorporation of a diffuser.

4. The bore-hole pump according to claim 3, wherein the receivers of the motor-side component project beyond a radial partition plane between the motor-side component and the pump-side component, and cover the cylinder-jacket shaped component on a peripheral side.

5. The bore-hole pump according to claim 4, wherein the motor-side component comprises a radial intermediate wall, which comprises a recess for leading through a motor shaft, and on the peripheral side comprises projections which at least in sections are directed to the motor, and which form the receivers for the fastening to the head part.

6. The bore-hole pump according to claim 5, wherein the radial intermediate wall comprises recesses for receiving free ends of a hook for fastening to the head part.

7. A method of manufacturing a bore-hole pump having a head part and a foot part, the foot part comprising at least a motor-side component and a pump-side component with a partition plane between the components extending essentially radially and transverse to a longitudinal axis of the bore-hole pump, the method comprising:

forming the motor-side component by metal casting, forming the pump-side component by a manufacturing method different from casting and comprising metal powder injection molding; and connecting the motor-side component and the pump-side component to one another by welding, wherein the pump-side component further comprises a cylinder-jacket shaped component forming inlet openings for fluid to be delivered by the bore-hole pump, the method further comprising:

forming the cylinder-jacket shaped component from a sheet metal section by bending, and clamping the cylinder-jacket shaped component between the motor-side component and a suction side of a first pump stage.

8. The method according to claim 7, wherein at least one of the motor-side component and the pump-side component is made of stainless steel.

9. The method according to claim 8, wherein both components are made of stainless steel.

10. The method according to claim 7, further comprising:

forming a radial wall on one of the two components of the foot part to directly contact a radial wall of the other component of the foot part.

11. The method according to claim 7, wherein one or more pump stages are incorporated between the head part and the foot part.

* * * * *